United States Patent [19]

Carroll

[11] 4,363,460

[45] Dec. 14, 1982

[54] TELEVISION STAND

[75] Inventor: Joseph W. Carroll, West Chester, Pa.

[73] Assignee: Kim Manufacturing Company, Downingtown, Pa.

[21] Appl. No.: 109,146

[22] Filed: Jan. 2, 1980

[51] Int. Cl.[3] ..... F16M 13/00

[52] U.S. Cl. ..... 248/415; 248/188.7; 248/425; 248/150

[58] Field of Search ..... 248/425, 188.7, 158, 248/165, 163, 415, 150

[56] References Cited

U.S. PATENT DOCUMENTS

| | | | |
|---|---|---|---|
| 2,730,388 | 1/1956 | Roberton | 248/150 X |
| 2,966,322 | 12/1960 | Robinson | 248/150 X |
| 3,207,452 | 9/1965 | Zimmerman | 248/188.7 X |
| 3,724,798 | 4/1973 | Lucasey | 248/425 X |

*Primary Examiner*—Wayne L. Shedd

*Attorney, Agent, or Firm*—Eugene E. Renz, Jr.

[57] ABSTRACT

A stand for television sets comprising a pair of inverted T-shaped leg sections each comprising a pair of leg members of L-shaped configuration which interengage and nest to form a four-legged base. An elongated bolt member is fixed at the head end to one of the leg sections and has a threaded end projecting beyond the top end of the base. When the leg sections are nested, the bolt is disposed in a concealed elongated cavity defined by the leg sections. A closure cap assembly is mounted at the upper terminal end of one of the vertical portions of one of the leg sections and in the illustrated embodiment forms an integral subassembly therewith. The overcap assembly has a configuration and arrangement to vertically align the leg members relative to one another and provide a certain parallelism of the parts so that all the bearing surfaces are parallel to one another and to the support surface such as a floor. A tray to which the television set is locked by conventional security fasteners is supported on the closure cap and is adapted for limited rotational movement relative thereto.

10 Claims, 11 Drawing Figures

TELEVISION STAND

BACKGROUND OF THE INVENTION

The present invention relates to a stand for television sets and specifically one adapted for use in hotels, motels, hospitals and other similar establishments accommodating the public which has security features preventing removal of the television from the room in which it is placed.

At present most hotels have television in each of the rooms as an accommodation to their clientele. Large losses occur each year by unauthorized removal of the television sets from the hotel premises. Consequently, in most instances the television sets are secured in such a fashion to inhibit unauthorized removal. In some cases the television set is bolted to a credenza or the like. This has not proven fool proof and often times in addition to loss of the television set, the credenza is damaged beyond repair in the course of removal of the television set therefrom. There are also presently so-called "security stands" to which the television set is secured and the stand in turn is bolted or otherwise attached to the floor. These stands, however, are of relatively complicated design and consequently are extremely costly to manufacture. It has been found that they are difficult to clean and maintain and assemble on location. The complicated assembly procedures of many units are objectionable because of time (cost) factor and require a certain mechanical skill to assemble and install.

With the above in mind, an object of the present invention is to provide a security stand for television sets which is of comparatively simplified design and comprises comparatively few parts which may be assembled easily and economically.

DESCRIPTION OF THE DRAWINGS

These and other objects of the present invention and the various features and details of the operation and construction thereof are hereinafter more fully set forth with reference to the accompanying drawings wherein.

DESCRIPTION OF A PREFERRED EMBODIMENT

Figure 1:
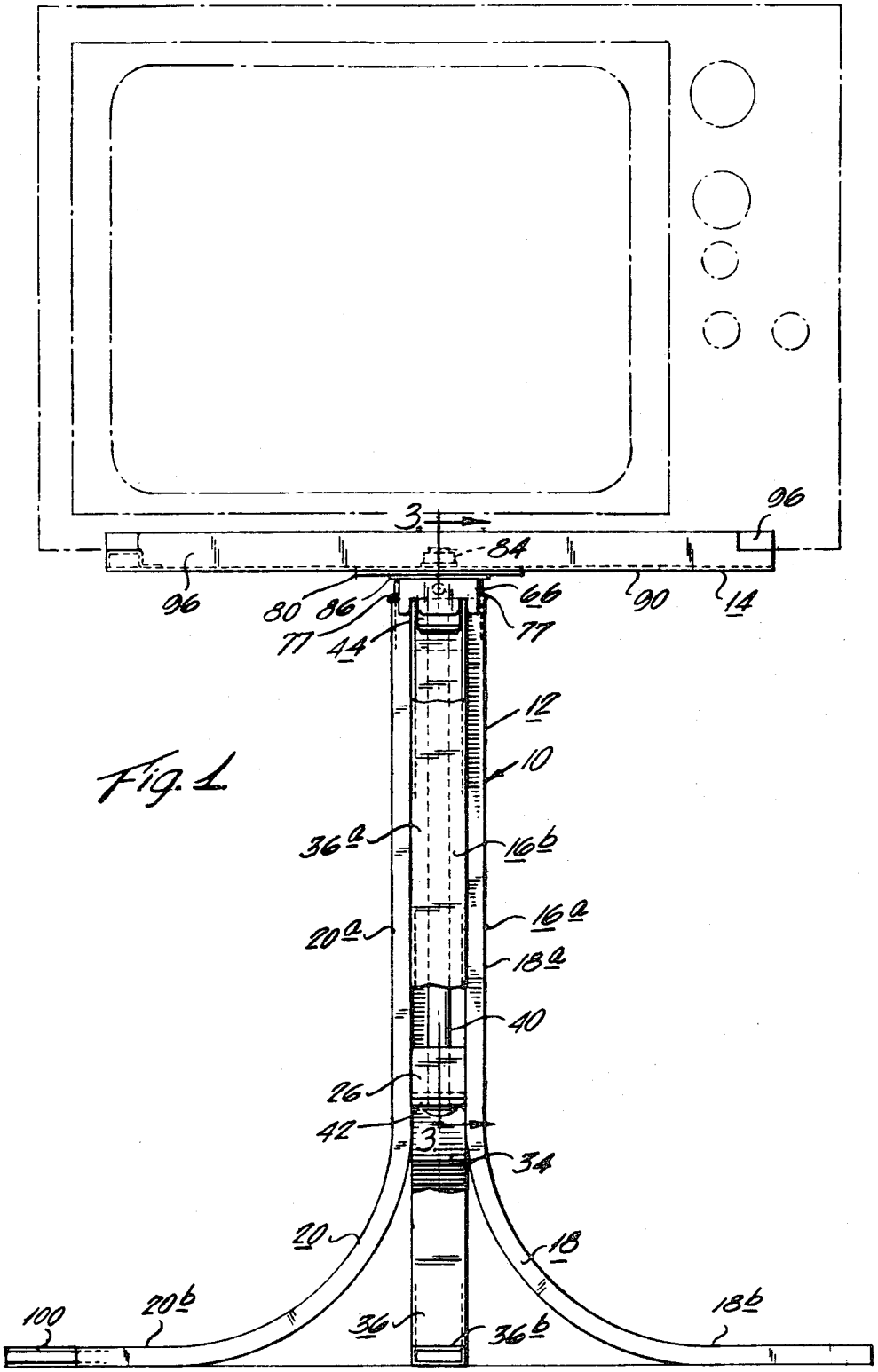
FIG. 1 is a side elevational view of a television stand in accordance with the present invention with parts broken away so that the internal construction may be seen more clearly.
Figure 2:
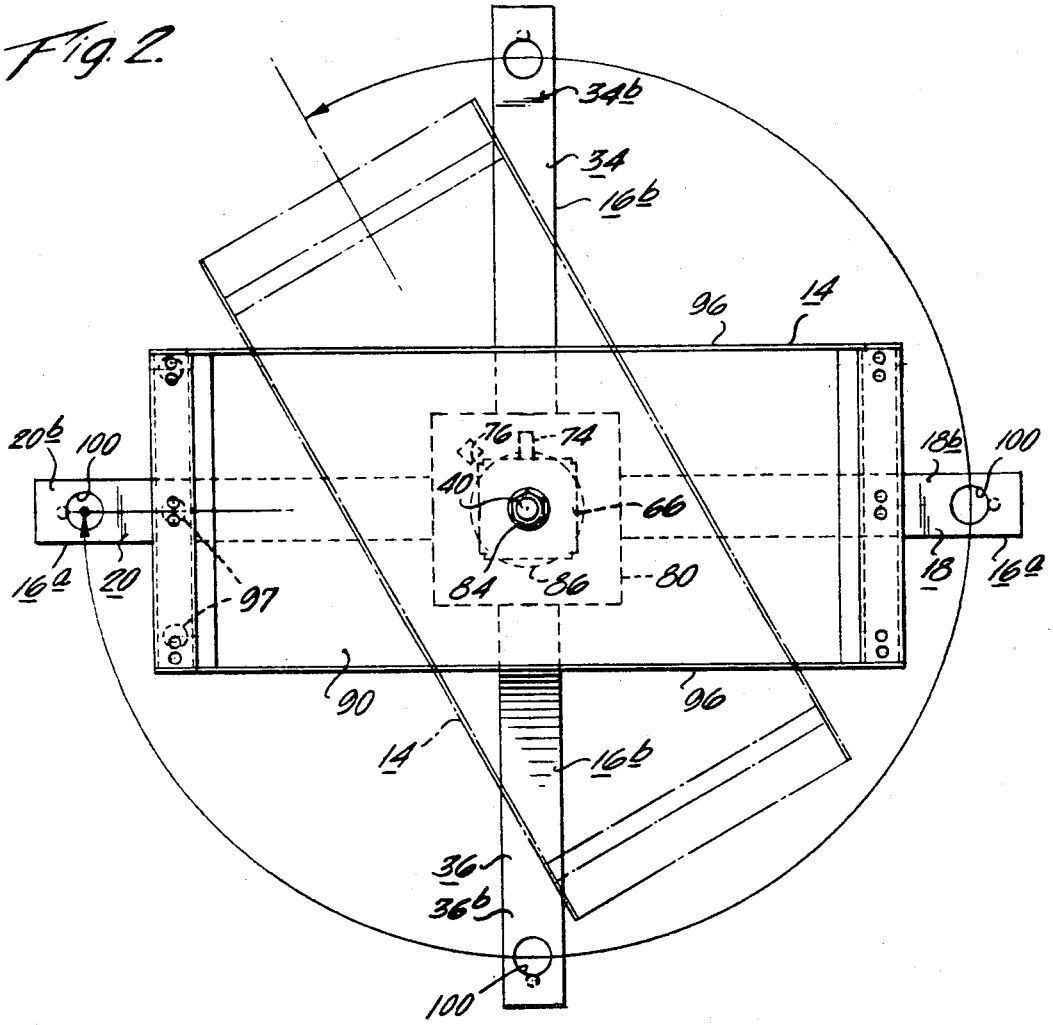
FIG. 2 is a top plan view of the stand.

Referring now to the drawings, particularly FIG. 1 thereof, the television stand which is generaly designated by the numeral 10 comprises a base 12 and a tray 14 on which the television is secured and which is mounted for limited rotation relative to the base 12. In the present instance, the base 12 consists of a pair of inverted T-shaped leg sections 16*a* and 16*b* which interengage and nest to form the four legged base illustrated. The base section 16*a* comprises a pair of leg members 18 and 20 which are hollow channel members of rectangular cross section and of generally L-shaped configuration defining vertical legs 18*a*, 20*a* and pedestals 18*b*, 20*b*. The leg members 18 and 20 are secured together to form the inverted T-configuration by a closure cap assembly 21 suitably fastened adjacent the upper terminal ends of the leg members and a support web 26 with an opening 32 spaced downwardly from the top cap which is secured to the leg members at the juncture of the vertical portion and the bend forming the pedestals. Closure cap assembly 21 and supporting web or plate 26 are in the present instance secured to the leg members by welding. Closure cap assembly 21 and web 26 have openings to receive a bolt forming part of the leg section 16*b* since it is welded to the strap 42 connecting the leg members of the leg section 16*b*.

The closure cap assembly 21 includes a top cap 22 having an opening 30, in the present instance of inverted U-shape secured by welding between the confronting faces of the leg members 18*a*, 20*a* of leg section 16*a* and a strap 44 also of inverted U-shaped cross section which straddles the top cap 22 and has a central opening 46 which registers with the opening 30 in the top cap 22 to allow passage of the threaded end of the bolt 40. The strap as illustrated has a generally rectangular top 48 with four short tangs 50 which project from opposing elongated side edges of the top adjacent to the corners. The strap 44 further includes depending tab sections 52 which have an inwardly offset portion 54 and outwardly feathered lower edge 56 to define in assembly with the top cap 22 a slot 60 of predetermined width so that the tab sections of the strap engage in the channel opening of the leg members 34*a* and 36*a* on assembly (see FIG. 3). The strap 44 is secured to the top cap 22, for example, by welding. The strap 44 has a pair of projections 62 which engage in openings 64 of the top cap 22 to ensure proper alignment. The closure cap assembly further includes an overcap 66 having side walls 68 with spaced slotted openings 70 extending upwardly from the bottom edge which permit nesting of the overcap in the channel openings of the leg members. Specifically two opposing side walls 68*a*, 68*a* have a pair of straight sided slots 70*a*, 70*a* spaced apart a given distance to straddle the opposing legs of section 16*a*. The side walls 68*b*, 68*b* have a pair of slots 70*b*, 70*b* which have bevelled pilot sections 72, 72 to permit easier assembly to the leg sections 34 and 36. The overcap also has a detent 74 projecting from one side which cooperates with a depending lug 76 on the tray to limit rotation of the television relative to the stand. In the assembled position the overcap 66 is secured in place over the strap 44 and bracket 22 subassembly to the base section 16*a* by welding as at 77.

The overcap 66 also has an enlarged central opening 78 of a diameter to permit nut 79 to be threaded to the threaded end of bolt 40 and tightened against strap 44 on assembly of the leg sections.

The leg section 16*b* likewise comprises a pair of leg members 34 and 36 of L-shaped configuration each having an elongated vertical leg 34*a*, 36*a* and a horizontal leg defining pedestals 34b, 36b connected by a smoothly arcuate section. These leg members 34 and 36 are also of channel construction and of rectangular cross section. The leg members 34 and 36 support between them an elongated bolt 40 having conventional threads at its upper terminal end. The bolt 40 is supported centrally between the vertical sections of the leg members by a bracket 42 by a weldment thereto at the head portion of the bolt. The bolt extends through the central opening in the top cap 22 and web 26 of the base section 16a.

The elongated rectangular tray 14 supporting the television has a central support plate 80 welded thereto which has an opening 82 through which the bolt 40 engages. The tray is firmly secured to the base by the top lock nut 84. A Teflon washer 86 is mounted between the overcap and plate of the tray to permit limited relative pivotal movement of the tray and television relative to the stand.

The tray 14 has a generally rectangular base 90 and upstanding side walls 96 which straddle the front and rear of the television set in the manner illustrated in FIG. 1. The television extends beyond the lateral ends of the tray 14 so that these ends underlie the television base. The ends of the tray 14 have a series of holes 97 for fasteners to lock the television to the tray. These fasteners are well known security screws which have a head configuration requiring a special tool to assemble and remove, thus locking the television securely to the tray 14.

Manufacture and assembly of the television stand assembly in accordance with the present invention is simple and economic. For example, the leg members 18, 20, 34 and 36 may be formed from conventional channel stock of rectangular cross section which is cut to a given length and then formed by a simple bending operation to the L-shape configuration of the individual legs as shown. The bolt 40 and support bracket 42 are then assembled to pairs of the leg members to form the leg section 16b. This involves nothing more than a simple welding operation. Similarly the leg section 16a is simply formed by welding the web 26 and closure cap assembly 21 in place. The web 26 and bracket 22 are formed by simple stamping operation. It is noted that bracket 22 and strap 44 are welded as a subassembly prior to welding to the legs of base section 16a and thereafter the overcap is seated on the leg section 16a until the slots 70a bottom and straddle the open end of the leg members 18a and 20a and secured in place by welding so that the bracket 22, step 44 and overcap form a unitary subassembly with the leg section 16a.

Figure 3:
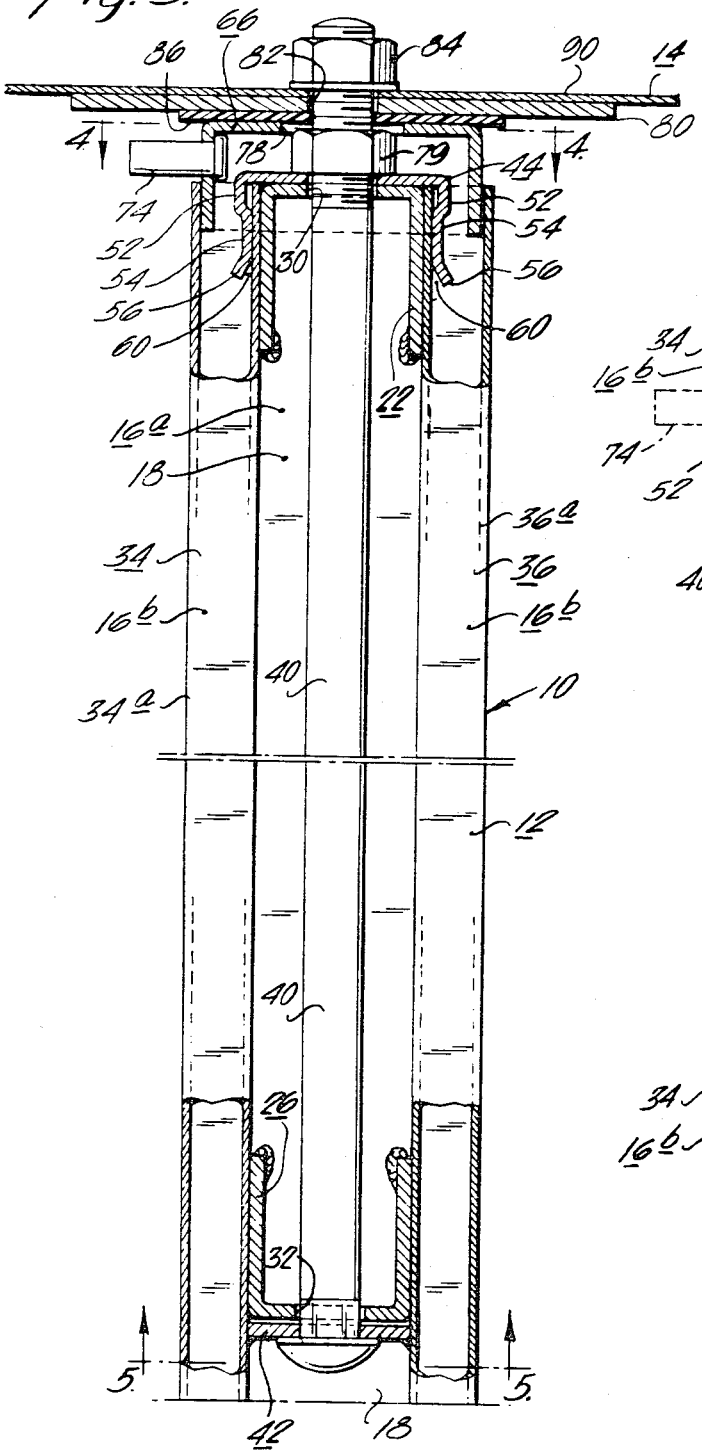
FIG. 3 is an enlarged sectional view taken on lines 3—3 of FIG. 1.
Figure 4:
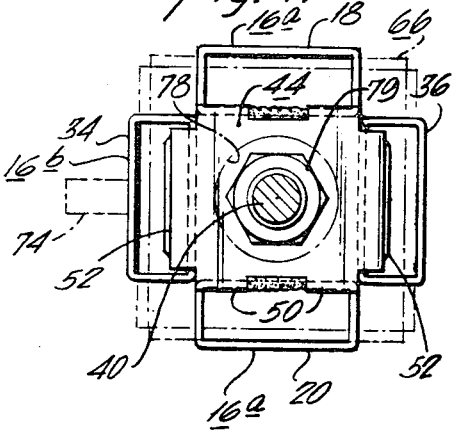
FIGS. 4 and 5 are sectional views taken on lines 4—4 and 5—5 respectively of FIG. 3.
Figure 5:
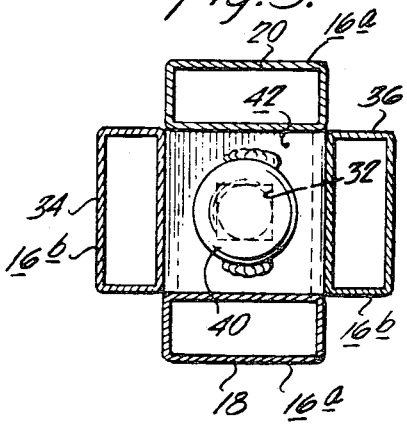
Figures 6, 7, 8, 9, 10, 11:
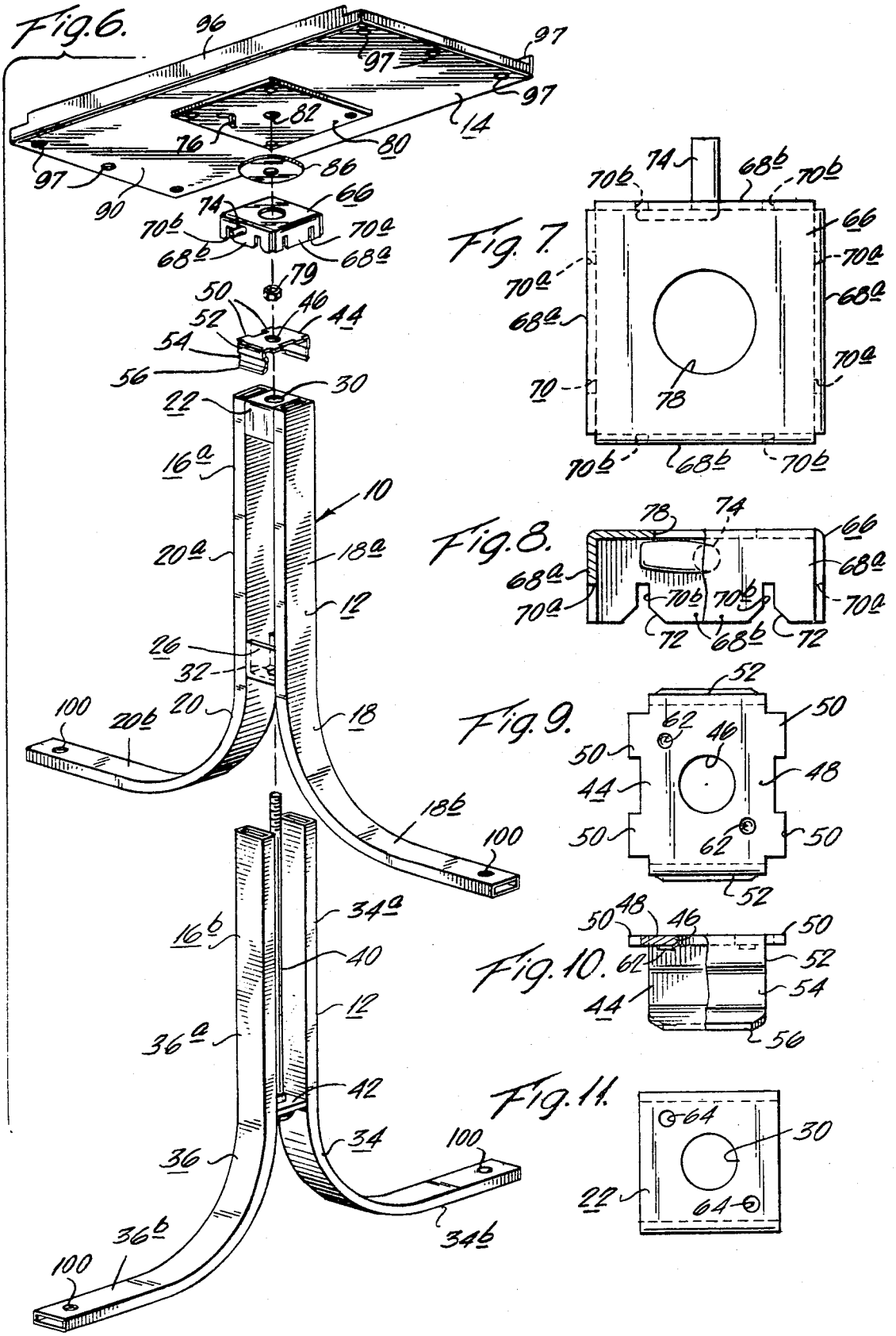
FIG. 6 is an exploded perspective view of the various elements comprising the television stand of the present invention.
FIG. 7 is a top plan view of the top cap piece for the stand forming an integral part of one of the leg sections.
FIG. 8 is a side elevation view thereof partly in section.
FIG. 9 is a top plan of the locating bracket also forming an integral part of one of the leg sections.
FIG. 10 is a side elevational view thereof partly in section of the locating bracket.
FIG. 11 is a top plan view of the top cap also forming an integral part of one of the leg sections.

The parts comprising the television stand assembly may be packaged in a compact manner and assembled at the site. The parts comprising the stand may be assembled simply by positioning the leg section 16b in an upright position and then positioning the other leg section 16a in nesting relation to the legs of section 16b so that the threaded end of the bolt 40 projects beyond the overcap 66. In this position the legs 52 of the strap 44 engage in the open upper terminal ends of the legs 34, 36, the confronting faces of the legs 34 and 36 nesting snugly in the slot 60 as illustrated in FIG. 3 and the slots 70b of the overcap 66 fit over the legs 34 and 36 to properly align the leg sections at the top of the stand (see FIGS. 4 and 5). In this position, the first lock nut 79 is torqued down to secure the leg assemblies together. By this action the open upper ends of the leg section 16b bottom in the slots 70b, 70b to position the leg members in vertical alignment and wherein the upper terminal ends of the leg sections are flush or lie in the same horizontal plane and the pedestals 18b, 20b, 34b and 36b lie flat on the support surface such as the floor. Note that in the assembled position the bracket 42 of leg section 16b and web 26 of leg section 16a are spaced apart slightly to allow for proper positioning of the leg sections to provide the vertical and parallel alignment discussed above. Thus, in addition to the alignment function, there is also provided an enclosed, concealed from view enclosure for the locking elements of the stand. The inaccessibility of the locking elements renders the stand assembly essentially "tamper-proof" for purposes of disassembly and thus it may be characterized in a sense as "theft-proof." The Teflon washer is then positioned in place and the outer lock nut 98 applied to the terminal end of the bolt. The television set may then be secured to the tray simply by engaging the fasteners through the openings in the end of the tray. If desired, the stand may be bolted to a support base or floor, and to this end, the outer terminal ends of the pedestals each is provided with a hole 100 through one wall thereof. A "Hilti" explosive drive charger may be utilized to drive an anchoring spike through the wall of the pedestal into the supporting surface or floor which may be concrete.

In summary, therefore, the television stand of the present invention is comprised of relatively few parts which are easy and economical to manufacture and which may be shipped in a compact manner and easily assembled at the site of use. The assembled unit is of streamlined configuration so that it is easy and economical to maintain and clean. Furthermore, the configuration of the internesting parts conceals from view the single locking element so that the stand is difficult to take apart once installed at a site and thus, may be truly characterized as a security stand.

Even though the invention has been illustrated and described in particular form, it is not intended to limit the invention and changes and modifications may be made therein within the scope of the following claims.

I claim:

1. A stand assembly comprising a pair of inverted generally T-shaped first and second leg sections, each leg section comprising a pair of hollow members of generally L-shaped configuration consisting of a vertical portion and a horizontal portion defining a pedestal member and a connecting member securing the vertical portions in spaced generally coplanar parallel relation to form a T-shaped leg section, a cap assembly secured to the upper ends of the vertical portion of said first leg section and having means engaging in the open terminal ends said second leg section thereby to align the vertical portions of the leg sections and position the horizontal portion in generally the same plane when the leg sections are interengaged and nested to form a four-legged assembly, a bolt member cooperating with said connecting members and engaging through said closure cap assembly and locking means engageable with the bolt member to secure the leg sections together.

2. A stand assembly as claimed in claim 1 wherein the closure cap assembly includes a top cap with a central opening therein secured to the inner confronting faces of the vertical legs of said second leg section, a strap of inverted U-shaped cross section secured to and straddling the top cap with a pair of depending tabs which are spaced from the exposed side walls of said top cap to define slots of a width slightly greater than the thickness of the tubular members and an overcap having depending side walls with a pair of spaced slots in each side wall which engage over the end walls of each of the vertical leg members.

3. A stand assembly as claimed in claim 2 wherein the overcap has an enlarged central opening to permit assembly of a lock nut to engage a threaded end of the bolt projecting through the top cap and strap.

4. A stand assembly as claimed in claim 3 including a second lock nut supporting a tray for pivotal movement on the overcap.

5. A stand assembly as claimed in claim 4 including a washer between said tray and overcap.

6. A stand assembly as claimed in claim 4 wherein said overcap includes a projection which cooperates a depending detent on the tray so that rotation of the tray relative to the base is limited to 360°.

7. A stand assembly as claimed in claim 1 wherein said bolt member is secured to said second leg section at the end thereof remote from said closure cap assembly.

8. A stand assembly as claimed in claim 1 wherein said closure cap assembly includes means defining slotted openings within which the inner terminal ends of said second leg section engage, thereby aligning the vertical portions of said leg sections in confronting parallel relation and fixing the vertical portions of said second leg section against lateral movement and longitudinal movement in one direction relative to the vertical portions of said first leg section.

9. A stand assembly as claimed in claim 1 wherein said connecting members comprise brackets connected to the vertical portions of the first and second leg sections adjacent to the juncture of the vertical and horizontal portions of the leg sections.

10. A television stand assembly comprising a pair of inverted T-shaped first and second leg sections, each leg section comprising members of L-shaped configuration, consisting of an elongated vertical portion and a horizontal portion defining a pedestal member, an elongated bolt member mounted between the vertical portions of said first leg section, and a closure cap assembly secured at the upper terminal ends of the vertical portion of said second leg section, said closure cap assembly including a top cap with a central opening therein secured to the inner confronting faces of the vertical portion of said second leg section, a strap of inverted U-shaped cross section secured to and straddling the top cap with a pair of depending tabs which are spaced from the exposed side walls of said top cap to define slots of a width slightly greater than the thickness of the channel members and an overcap having depending side walls with a pair of spaced slots in each side wall which engage over the end walls of each of the vertical portions, said leg section interengaging and nesting to form a four-legged assembly wherein the bolt member engages through said closure cap assembly and locking means engageable with the bolt member to secure the leg sections together.

* * * * *